US010682857B2

(12) United States Patent
Ferreri et al.

(10) Patent No.: US 10,682,857 B2
(45) Date of Patent: Jun. 16, 2020

(54) ADAPTIVE INK FLUSHING OF A PRINTER

(71) Applicants: Vincent William Ferreri, Frederick, CO (US); Walter F. Kailey, Frederick, CO (US)

(72) Inventors: Vincent William Ferreri, Frederick, CO (US); Walter F. Kailey, Frederick, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/018,501

(22) Filed: Jun. 26, 2018

(65) Prior Publication Data

US 2019/0389221 A1 Dec. 26, 2019

(51) Int. Cl.
*B41J 2/165* (2006.01)
*B41J 2/045* (2006.01)

(52) U.S. Cl.
CPC ..... *B41J 2/1652* (2013.01); *B41J 2/04536* (2013.01); *B41J 2/16526* (2013.01); *B41J 2/16517* (2013.01); *B41J 2/16579* (2013.01); *B41J 2002/16529* (2013.01)

(58) Field of Classification Search
CPC ..... B41J 2/2142; B41J 2/16579; B41J 2002/16573; B41J 2/16517
See application file for complete search history.

(56) References Cited

U.S. PATENT DOCUMENTS 5,659,342 A 8/1997 Lund et al.
6,345,878 B1 2/2002 Kanaya
6,352,333 B1 3/2002 Matsumoto et al.
6,481,823 B1 * 11/2002 Bauer ..... B41J 2/16526 347/23
6,508,528 B2 1/2003 Fujii et al.
6,561,622 B1 5/2003 Suzuki et al.
7,303,250 B2 12/2007 Akase et al.
7,452,045 B2 11/2008 Suzuki
7,862,145 B2 1/2011 Umezawa
8,007,071 B2 8/2011 Hayakawa
8,104,854 B2 1/2012 Sekiguchi
8,662,635 B2 3/2014 Yuda et al.
8,944,553 B2 2/2015 Walker et al.
9,061,518 B2 6/2015 Chandu et al.
9,352,570 B2 5/2016 Yamazaki et al.
9,809,036 B2 11/2017 Chandu et al.
9,889,668 B2 2/2018 Kifuku
2010/0053241 A1 3/2010 Chandu et al.
2010/0245438 A1 9/2010 Furuhata et al.
2010/0328385 A1 12/2010 Shibata et al.
2013/0076820 A1 3/2013 Chandu et al.
2014/0104334 A1 4/2014 Ikarashi
(Continued)

OTHER PUBLICATIONS

European Search Report; Application No. EP19174787; dated Nov. 14, 2019.

*Primary Examiner* — Geoffrey S Mruk
(74) *Attorney, Agent, or Firm* — Duft & Bornsen, PC

(57) ABSTRACT

Systems and methods are provided for adaptive ink flushing of a printer. One embodiment is an apparatus that includes an adaptive ink flushing controller configured to obtain nozzle firing data for a nozzle of a printhead, to analyze the nozzle firing data to determine an inactive firing span of the nozzle, and, in response to determining that the inactive firing span of the nozzle exceeds a threshold, to transmit a firing instruction for ejecting ink.

14 Claims, 6 Drawing Sheets

(56) References Cited

U.S. PATENT DOCUMENTS

| | | | | |
|---|---|---|---|---|
| 2015/0062239 | A1 | 3/2015 | Wakabayashi et al. | |
| 2017/0087832 | A1 | 3/2017 | Hyakudome et al. | |
| 2018/0236763 | A1* | 8/2018 | Tanaka | B41J 2/165 |

* cited by examiner

ADAPTIVE INK FLUSHING OF A PRINTER

FIELD OF THE INVENTION

The invention relates to the field of printing, and in particular, to flushing nozzles of printheads.

BACKGROUND

Entities with substantial printing demands often use a production printer that prints on a web of print media at high-speed (e.g., one hundred pages per minute or more). A production printer typically includes a print controller that controls the overall operation of the printing system, and a print engine that physically marks the web. The print engine has an array of printheads and each individual printhead includes multiple tiny nozzles (e.g., 360 nozzles per printhead depending on resolution) that are operable to discharge ink as controlled by the printhead controller.

To ensure that ink does not dry in the nozzle (which can clog the nozzle and decrease print quality), flush marks are periodically printed by the nozzles. The flush marks may be printed onto non-used portions of the web. Alternatively, nozzle flushing may be dispersed within portions of the web marked with print data. However, printing flush lines at the margins of the web tends to waste ink, and printing flush patterns within the printed image tends to reduce the quality of the printed output.

SUMMARY

Embodiments described herein provide systems and methods that adaptively flush ink of a printer. In particular, print data is analyzed to determine periods of inactivity for individual nozzles, and the ink usage for flushing operations is adaptively minimized based on the print data. As such, a nozzle that is sufficiently active according to print data may be partially or fully restricted from printing in flush operations. Advantageously, the adaptive flushing minimizes ink usage/waste for flushing and, for pattern flushing, may also make the flushed ink on the web less apparent to the human eye to improve print quality.

One embodiment is an apparatus that includes an adaptive ink flushing controller configured to obtain nozzle firing data for a nozzle of a printhead, to analyze the nozzle firing data to determine an inactive firing span of the nozzle, and, in response to determining that the inactive firing span of the nozzle exceeds a threshold, to transmit a firing instruction for ejecting ink.

Other example embodiments (e.g., methods and computer-readable media relating to the foregoing embodiments) may be described below.

DESCRIPTION OF THE DRAWINGS

Some embodiments are now described, by way of example only, and with reference to the accompanying drawings. The same reference number represents the same element or the same type of element on all drawings.

DETAILED DESCRIPTION

The figures and the following description illustrate specific example embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
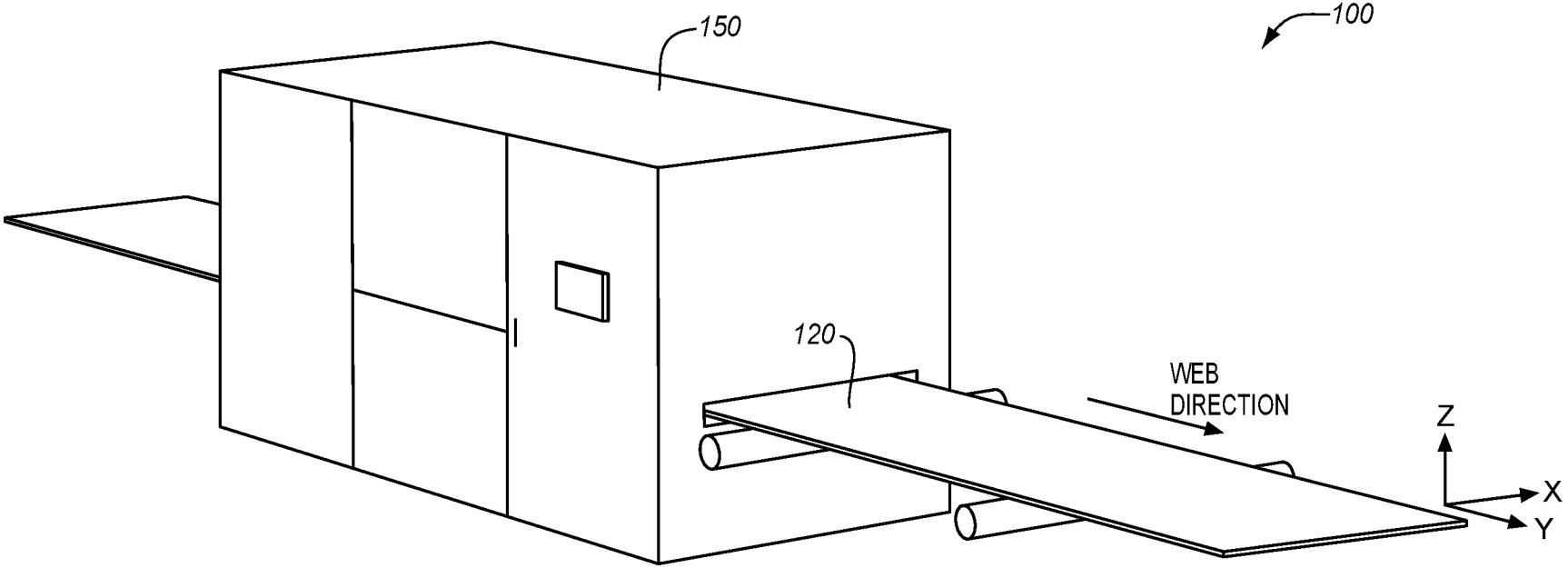
FIG. 1 illustrates a print system in an illustrative embodiment.

FIG. 1 illustrates a print system 100 in an illustrative embodiment. The print system 100 includes a printer 150 that applies marks to a print medium 120. The applied marking material may comprise ink in the form of any suitable fluid (e.g., aqueous inks, oil-based paints, additive manufacturing materials, etc.) for marking the print medium 120. As shown in this example, the printer 150 may comprise a continuous-form inkjet printer that prints on a web of continuous-form media, such as paper. However, embodiments described herein may apply to alternative print systems such as cut-sheet printers, wide format printers, etc. FIG. 1 illustrates a direction in which the print medium 120 travels during printing (Y) (i.e., a process direction), a lateral direction (X) perpendicular to a Y direction (i.e., a cross-process direction), and a direction Z.

Figure 2:
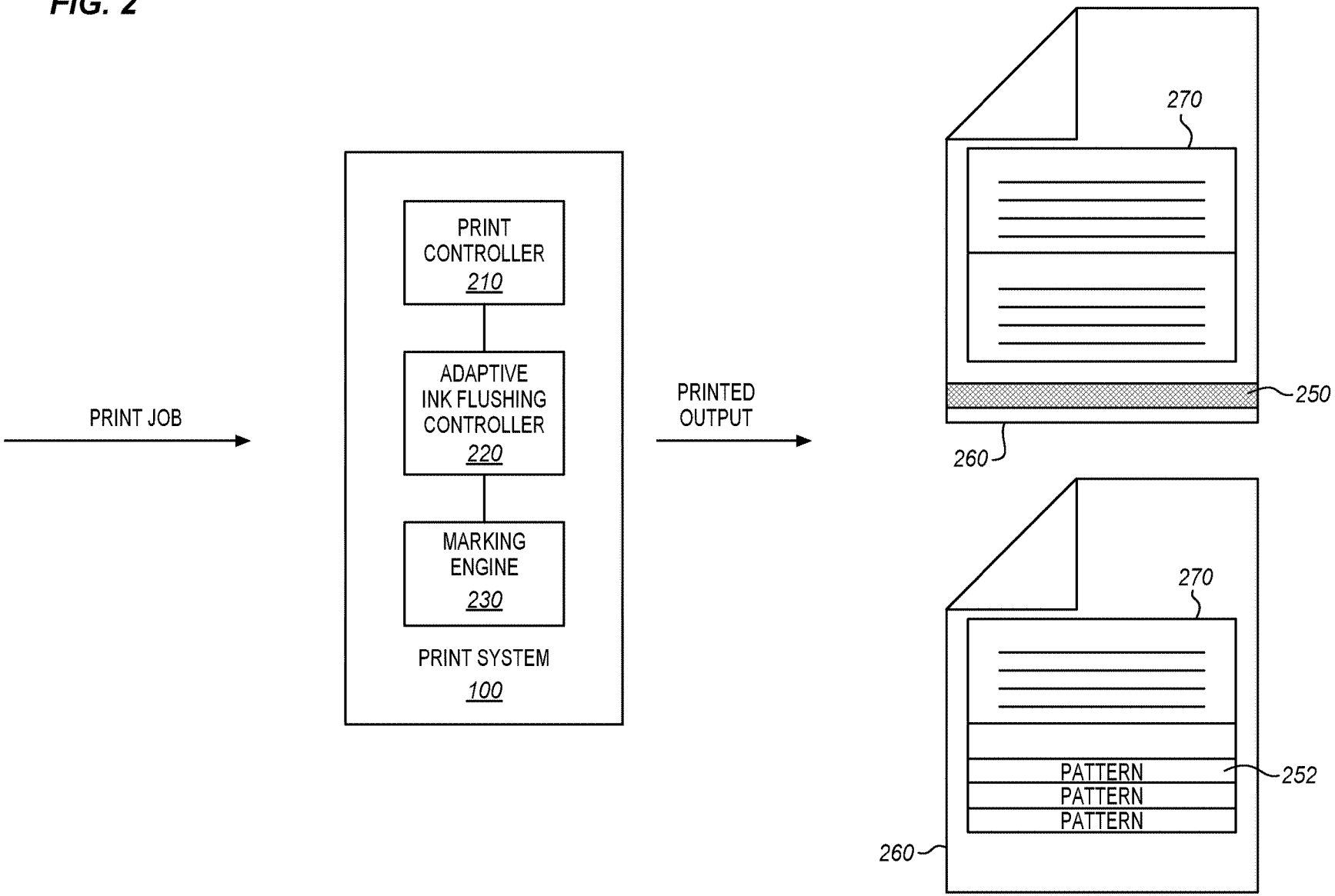
FIG. 2 is a diagram of the print system in an illustrative embodiment.

FIG. 2 is a diagram of the print system 100 in an illustrative embodiment. The print system 100 includes a print controller 210, an adaptive ink flushing controller 220, and a marking engine 230. The print controller 210 receives and prepares print jobs for printing, and the marking engine 230 marks the print medium 120 with ink to generate physical output for received print jobs. The adaptive ink flushing controller 220 generates flush marks for print jobs to prevent ink from clogging in printhead nozzles of the marking engine 230 to ensure high print quality.

The print system 100 may periodically output flush marks as a flush line 250 or a flush pattern 252. The flush line 250 is typically printed on a page 260 as a solid region of ink at page boundaries (e.g., top or bottom page margin) outside the printed image 270. The flush line 250 may be cut from the page 260 in post-print handling. By contrast, the flush pattern 252 is typically printed on the page 260 as small dots, or "stars," scattered through the page 260 and comingled with the printed image 270. Although the flush pattern 252 generally uses less ink than the flushing line 250, it cannot be cut out of the printed image 270 after printing. In existing printing systems, flushing (which may also be referred to as purging, cleaning, or spitting) causes extra nozzle firings in a printer that are not part of the print data. However, prior systems are prone to wasting expensive ink in flushing operations in attempt to ensure that nozzles do not become clogged, and for pattern flushing, the print quality is subject to degradation as a result of excess flushing causing an undesirable loss of contrast and fidelity to fine details in the printed image. For example, pattern flushing may sometimes impair bar codes or other small print detail in the printed output.

The adaptive ink flushing controller 220 is thus enhanced to generate flush marks that improve image quality in printing flush patterns 252 and/or that minimize ink waste in printing either flush patterns 252 or flush lines 250. Advantageously, the adaptive ink flushing controller 220 allows print job data to serve as at least some of the flushing in regions where ink output occurs to reduce ink waste and/or improve the quality of the printed image. The adaptive ink flushing controller 220 may be implemented, for example, as custom circuitry, as a special or general purpose processor executing programmed instructions stored in an associated program memory, or some combination thereof. While the adaptive ink flushing controller 220 is illustrated as an independent element in FIG. 2, in some embodiments the adaptive ink flushing controller 220 may be integrated into the print controller 210 and/or the marking engine 230. Illustrative details of the operation of the adaptive ink flushing controller 220 will be discussed with regard to FIG. 3.

Figure 3:
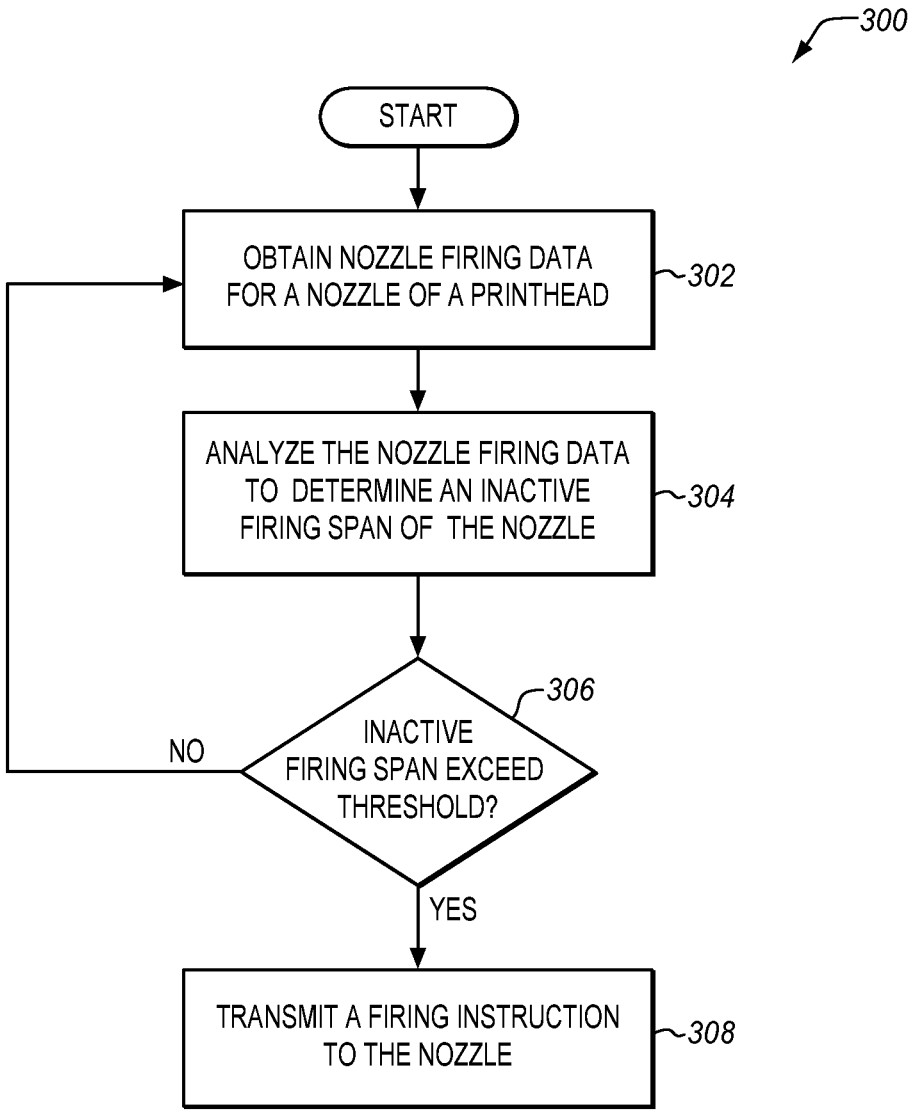
FIG. 3 is a flowchart illustrating a method of flushing ink in an illustrative embodiment.

FIG. 3 is a flowchart illustrating a method 300 of flushing ink in an illustrative embodiment. The steps of the method 300 are described with reference to the print system 100 of FIGS. 1 and 2, but those skilled in the art will appreciate that the method 300 may be performed in other systems. The steps of the flowcharts described herein are not all inclusive and may include other steps not shown. The steps described herein may also be performed in an alternative order.

In step 302, the adaptive ink flushing controller 220 obtains nozzle firing data for a nozzle of a printhead. Nozzle firing data (e.g., image data, bitmap data, etc.) may define which nozzles eject ink in a scanline, thereby converting digital information into printed images on the print medium 120. The adaptive ink flushing controller 220 may obtain the nozzle firing data in real time (e.g., as nozzle firing data is transmitted to the nozzle) or in advance of the nozzle receiving the data.

In step 304, the adaptive ink flushing controller 220 analyzes the nozzle firing data to determine an inactive firing span of the nozzle. In some embodiments, the adaptive ink flushing controller 220 is configured to determine the inactive firing span of the nozzle by counting between nozzle firings of the nozzle according to the nozzle firing data. For example, the adaptive ink flushing controller 220 may implement a counter (e.g., timers, registers, etc.) that tracks the firing activity of a nozzle and advances in increments of time (e.g., counts up/down one unit) or time related events as the nozzle does not eject ink (or as the nozzle ejects ink depending on the counter type). The time related events may include various parameters of the print system 100 such as scanline advancement or print medium advancement. The time related events may be correlated to time based on one or more determined characteristics of the time related event such as printing speed, scanline printing speed, or print medium advancement speed.

In step 306, the adaptive ink flushing controller 220 determines whether the inactive firing span exceeds (e.g., goes beyond) a threshold. If so, the method 300 advances to step 308 and the adaptive ink flushing controller 220 transmits a firing instruction for ejecting ink to the nozzle and/or another device (e.g., to memory or a buffer for later transmission to a nozzle). The firing instruction may cause the nozzle to expel an ink drop or at least create an oscillation of ink contained in the nozzle. Otherwise, if the inactive firing span has not exceeded the threshold, the method 300 returns to step 302 and repeats. Thus, if the inactive period of the nozzle is too long, the adaptive ink flushing controller 220 may instruct the nozzle to expel an ink drop to refresh the nozzle. Steps 302-308 may repeat during printing for multiple nozzles of the marking engine 230 in parallel. Advantageously, the method 300 adapts nozzle firing data to serve as flushing for active nozzles to minimize unnecessary flushing while still adequately refreshing inactive nozzles. As such, the print system 100 may output flush marks that reduce ink waste, improve the quality of the printed image, or both.

Figure 4:
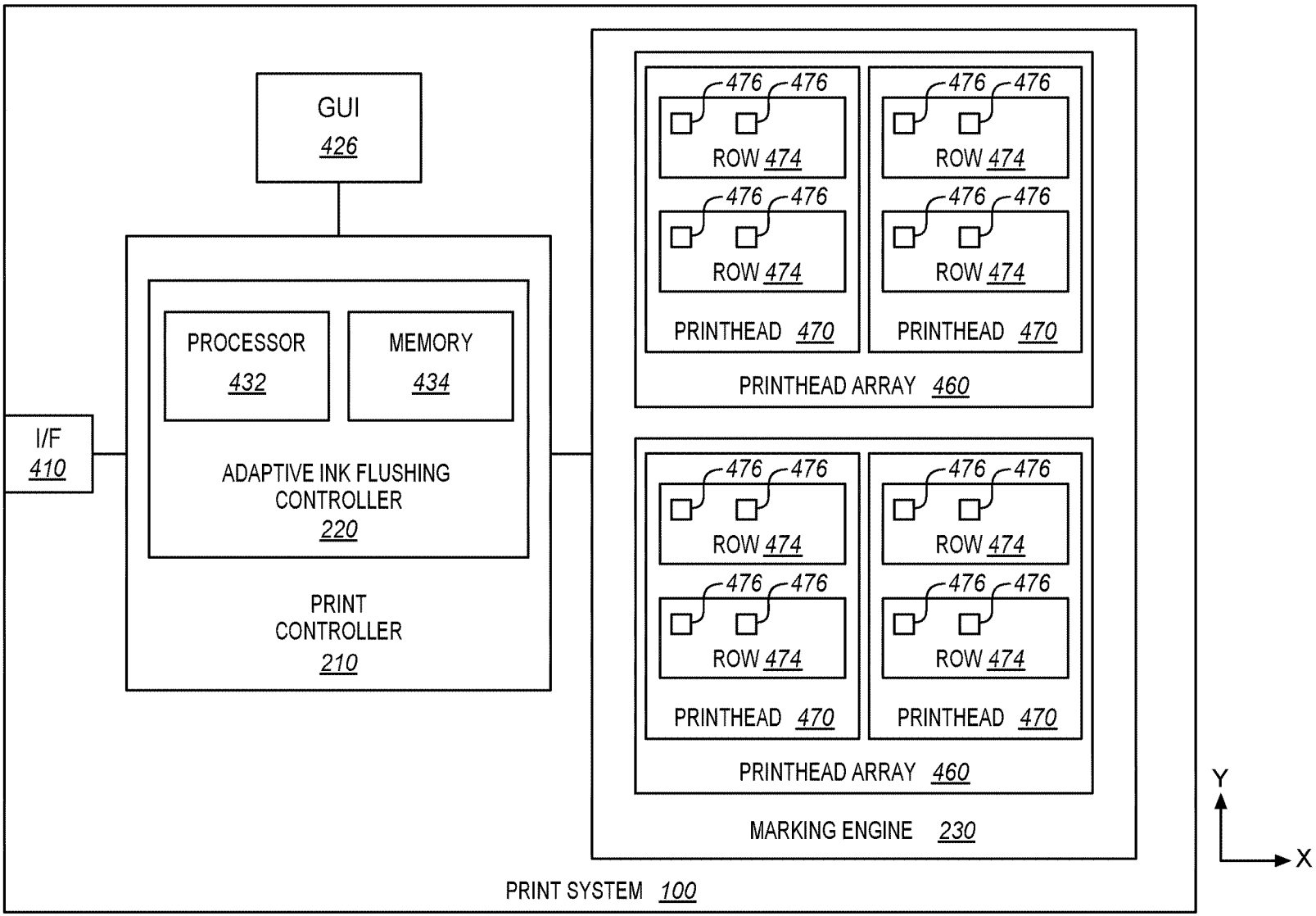
FIG. 4 is a diagram of the print system in another illustrative embodiment.

FIG. 4 is a diagram of the print system 100 in another illustrative embodiment. As shown in FIG. 4, the print system 100 may include an interface 410 to receive print data over a wired or wireless network, and a graphical user interface (GUI) 426 to receive user input (e.g., via keyboard, mouse, display screen, etc.). Additionally, the marking engine 230 may include one or more printhead arrays 460, and each printhead array 460 may include one or more printheads 470. The printheads 470 may comprise an inkjet printhead such as a Drop-On-Demand (DOD) printhead that uses heating elements or piezoelectric elements to propel ink or a continuous ejection printhead that uses a continuous stream of ink and electrostatic fields to control ink marking.

Each printhead 470 may include multiple rows 474 of nozzles 476 which are separated along the Y direction (i.e., process direction), the X direction (i.e., cross-process direction) or both. Each nozzle 476 is configured to discharge/eject drops of ink onto the print medium 120. Additionally, each nozzle 476 may eject a plurality of drop sizes (e.g., none, small, medium and large). The printheads 470 may be fixed such that each nozzle 476 consistently marks a specific, predefined location along the X direction (i.e., cross-process direction). Alternatively, the printheads 470 may be operable to move along the X direction. During printing, the print medium 120 passes underneath the printhead arrays 460 while the nozzles 476 discharge ink to form pixels on the print medium 120.

The print controller 210 receives print data via the interface 410, and prepares the print data for printing on the marking engine 230. In doing so, the print controller 210 may perform various image processing tasks for typical printing operations, such as color management, color separation, color linearization, interpreting, rendering, rasterizing, halftoning, or otherwise converting raw sheet images of a print job into sheetside bitmaps. For example, the print controller 210 may utilize one or more Rasterization Image Processors (RIPs) to translate the print data into bitmap data. A bitmap is a two-dimensional array of pixels representing a pattern of ink drops to be applied to the print medium 120 to form an image (or page) of a print job. With a generated bitmap, the print controller 210 may determine the location and type of every ink drop to be printed for each ink channel and direct printhead(s) 470 accordingly.

The print controller 210 may implement or communicate with the adaptive ink flushing controller 220 to efficiently control flushing of the nozzles 476. Though sometimes shown and described herein as a component of the print controller 210, the adaptive ink flushing controller 220 may alternatively or additionally operate independently of the print controller 210 and/or operate with alternative components of the print system 100. For example, in some embodiments, the adaptive ink flushing controller 220 may be integrated with the marking engine 230 to analyze nozzle firing data and to control the nozzles 476.

To perform functions, the adaptive ink flushing controller 220 (and/or the print controller 210) may be implemented by a processor 432 communicatively coupled to a memory 434. The processor 432 includes any electronic circuits and/or optical circuits that are able to perform functions. For example, the processor 432 may include one or more Central Processing Units (CPUs), Graphics Processing Units (GPUs), microprocessors, Digital Signal Processors (DSPs), Application-specific Integrated Circuits (ASICs), Programmable Logic Devices (PLDs), control circuitry, etc. Some examples of processors include INTEL® CORE™ processors, Advanced Reduced Instruction Set Computing (RISC) Machines (ARM®) processors, etc. The memory 434 includes any electronic circuits, optical circuits, and/or magnetic circuits that are able to store data. For instance, the memory 434 may include one or more volatile or non-volatile Dynamic Random Access Memory (DRAM) devices, FLASH devices, volatile or nonvolatile Static RAM (SRAM) devices, magnetic disk drives, Solid State Disks (SSDs), etc. Some examples of non-volatile DRAM and SRAM include battery-backed DRAM and battery-backed SRAM. The particular arrangement, number, and configuration of components described herein are non-limiting examples. Additional details of operation are described below.

Figure 5:
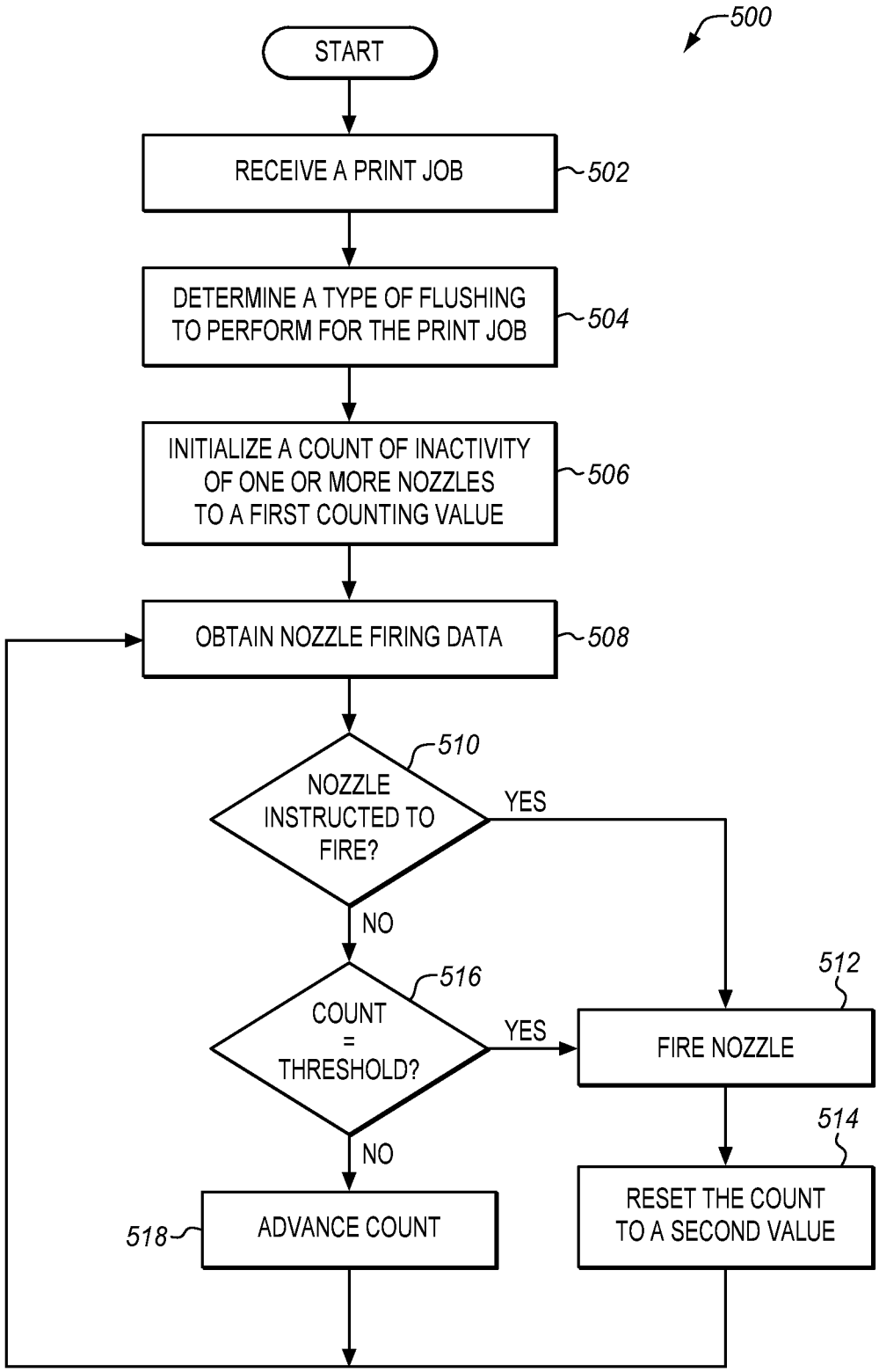
FIG. 5 is a flowchart illustrating a method of flushing ink in an illustrative embodiment.

FIG. 5 is a flowchart illustrating a method 500 of flushing ink in another illustrative embodiment. Assume, for this embodiment, that the print system 100 has initialized and is awaiting receipt of a print job for processing. In step 502, the print controller 210 receives a print job. The print controller 210 may obtain/convert print data such as an Intelligent Printer Data Stream (IPDS), PostScript data, Printer Command Language (PCL), or any other suitable format, into bitmaps for printing to the print medium 120 with printhead(s) 470. The print controller 210 may command the printheads 470 to eject a number of ink drops of corresponding ink drop sizes and colors according to sheet bitmaps of the print job.

In step 504, the adaptive ink flushing controller 220 determines a type of flushing to perform for the print job. For example, the adaptive ink flushing controller 220 may determine whether to output flush lines, flush patterns, or some combination thereof for the print job. In any case, flushing may be performed periodically throughout the print job (e.g., once per page, once every set distance of linear feet of a web of print media, etc.). Parameters and/or instructions of the flushing, including the flush type (e.g., flush lines 250 or flush patterns 252), may be received by the adaptive ink flushing controller 220 and/or input or selected by a user via the GUI 426.

In step 506, the adaptive ink flushing controller 220 initializes a count of inactivity of one or more nozzles 476 to a first counting value. The adaptive ink flushing controller 220 may implement a count for multiple nozzles 476 in parallel for periods of inactivity in increments of time or time-related events. For example, to track periods of inactivity based on time-related events or a determined effective time, the adaptive ink flushing controller 220 may detect scanlines (i.e., rows) of print data and determine which nozzles 476 in the scanline are to eject a drop. The adaptive ink flushing controller 220 may then determine inactive periods based on the rate or frequency of printing the rows.

In step 508, the adaptive ink flushing controller 220 obtains nozzle firing data for the nozzles 476. In addition to indicating whether or not a nozzle is to fire, the nozzle firing data may also indicate a type of ink drop to eject such as the size and/or color of the ink drop. For example, each pixel on a bitmap may correspond with a 2-bit value indicating one of four possible firing signals or drop sizes for a nozzle to eject—none, small, medium, or large. The adaptive ink flushing controller 220 may correlate one or more of the nozzles 476 with nozzle firing data (e.g., columns of marking data according to the scanline) based on corresponding locations of the nozzles 476 and pixels in the bitmap. Accordingly, the adaptive ink flushing controller 220 may determine the size of each ink drop to be printed by a nozzle.

In step 510, the adaptive ink flushing controller 220 determines whether the nozzles 476 are instructed to fire a non-zero size drop according to the nozzle firing data. For one or more nozzle(s) instructed to fire, the method 500 proceeds to step 512 to fire the nozzle(s) 476. Thus, the adaptive ink flushing controller 220 may process nozzle firing data generated by the print controller 210 without interrupting the transmission of the nozzle firing data to the printheads 470 or nozzles 476. After firing the appropriate nozzle(s) 476 according the nozzle firing data, the method 500 proceeds to step 514 and the adaptive ink flushing controller 220 resets the count(s) of fired nozzle(s) to a second value. That is, adaptive ink flushing controller 220 may reset the counters for each of the nozzles 476 instructed to fire according to the nozzle firing data.

Otherwise, for one or more nozzle(s) not instructed to fire according to the nozzle firing data and step 510, the method 500 proceeds to step 516 and the adaptive ink flushing controller 220 determines whether the count(s) of those nozzle(s) exceeds a threshold. If, in step 516, it is determined that a count has reached or exceeded the threshold, the method 500 proceeds to steps 512-514 to fire the nozzle(s) having the expired (e.g., exceeded the threshold) count(s), and to reset the count(s) of those nozzle(s) to a second value. Thus, the adaptive ink flushing controller 220 may generate or otherwise cause the transmission of a firing signal (or flush instruction) to a nozzle in response to detecting that a counter associated with the nozzle is expired. Moreover, whether a nozzle is fired according to print data or a flushing instruction, its count is reset to the second value which is a reset value that may be different than its initial value set in step 506. Otherwise, if in step 516, the count has not yet reached or exceeded its threshold, the method 500 proceeds to step 518 and the count advances (e.g., increments or decrements). Steps 508-518 may repeat as a print job is processed and/or printed. In another embodiment, step 512 modifies and stores the firing data so that the modified firing data may be used for printing at a later time.

In the method 500, the adaptive ink flushing controller 220 is configured to implement and maintain a counter that enables active nozzles to be flushed by the print data of the print job yet also enables inactive nozzles to be flushed if not recently fired during printing of the print job. As such, the method 500 may optimize the amount of ink to eject in flushing operations during the print job. It will be appreciated that the performance of particular steps of the method 500, including steps 508-518, may be executed in parallel for individual nozzles belonging to a group of nozzles under the control of the adaptive ink flushing controller 220.

The method 500 may be used to print flush lines 250 or flush patterns 252. In embodiments that print flush patterns 252, it may be desirable to prevent the nozzles 476 from simultaneously flushing across the page to reduce visible patterns in the printed output. Accordingly, the adaptive ink flushing controller 220 may set the counts of nozzles 476 to randomly distributed values. For example, in step 506, the adaptive ink flushing controller 220 may initially (e.g., at the start of a print job or page) set the first counting values of the nozzles 476 to random values such that adjacent nozzles have different first counting values than adjacent nozzles.

For embodiments in which the counter decrements, or counts down, the threshold may be set to zero, and the counter may decrement in value each time the nozzles 476 are not fired in a scanline of print data. If the count reaches zero, a nozzle firing signal is sent to the nozzle 476 and the count is reestablished with a reset value. Alternatively, for embodiments in which the counter increments, or counts up, the threshold may be set to a maximum value, and the counter may increment in value each time the nozzles 476 are not fired in a scanline of print data. If the sum of the current count and a reset value reaches the maximum value, a nozzle firing signal is sent to the nozzle 476 and the count is reestablished with a reset value. In some embodiments, the threshold for a nozzle may vary based on ink type (e.g., ink formulas that vary based on color, pigment, dye, or other content) to be ejected from the nozzle due to different ink formulas affecting nozzle clogging performance differently. The ink type and/or threshold for one or more nozzles may be set by a user via the GUI 426 and/or selected by the adaptive ink flushing controller 220 based on a lookup table.

Alternatively or additionally, to prevent the nozzles 476 from simultaneously flushing across the page and reduce visible patterns in the printed output, the adaptive ink flushing controller 220 may, in step 514, reset fired nozzles to the second counting values based on random numbers, the size of the drops previously ejected from the particular nozzle, weighted averages of prior firing data for the particular nozzle, the firing history or reset value of neighboring nozzles, and/or the location/number of the scanline or print line at the time of reset. For example, in one embodiment, the adaptive ink flushing controller 220 determines the second counting value based at least in part on the size of the ink drop that is being fired. That is, the counter may be reset to an increased value for larger drops and a decreased value for smaller drops. By varying the average reset value used for the counter based on the size of the drop that is fired, the time/distance to the next flushing mark may be adjusted to take advantage of the greater flushing effect of larger ink drops.

In another embodiment, the adaptive ink flushing controller 220 determines the second counting value based on prior value(s) of the counter at reset. For example, the adaptive ink flushing controller 220 may reset the counter to an average counter value whenever a non-zero ink drop is output. Alternatively, the adaptive ink flushing controller 220 may determine the second counting values based on uniformly distributed values. For example, the adaptive ink flushing controller 220 may implement an exponential average infinite impulse response (IIR) filter or a nonlinear filter to determine the reset value. In one example, uniformly distributed values between 0.5 and 1.5 times the average reset value may be drawn for each nozzle. The same series of resets may be use for future resets. To avoid using the same reset value for each nozzle, the reset value may be determined based on an index of the sum of the column (i.e., nozzle) number and the row number where the reset occurs. This has the effect of scrambling the resets so that hard edges within the image do not cause noticeable features within the flush pattern 252. By varying the average reset value according to the prior value of the counter at reset, the cumulative effect of multiple recently-fired drops can be taken into account in determining when to next flush the nozzle.

To adaptively determine the location of flushing pixels, the adaptive ink flushing controller 220 may implement or interface with parallel processors, such as multiple GPUs, that halftone the image. In general, halftoning converts the image data to a pattern of drops which, when viewed, resemble the image data even though they have been printed using a relatively small set of different drop types. In the halftoning process, the contone level of the transformed image data may be rendered with different sets of drop patterns each designed to achieve varying levels of optical density to represent the tonal levels of the image when printed.

The adaptive ink flushing controller 220 may use the job data and the halftone to determine which particular nozzles corresponding to pixels are to be fired for flushing. In some embodiments, the ink drop size for many pixels in the same line is simultaneously selected by parallel computation. Such determination may be performed during or after halftoning since the halftoning process may alter the printed output in quasi-random manner. Since many print systems perform halftoning as a real-time process that occurs as the paper is in motion, embodiments with a parallel processor implementation may enhance throughput due to the computational constraints associated with halftoning. Alternatively or additionally, some embodiments may generate a sheetside contone image that does not include the step of halftoning. In this case, the sheetside may be supplied to the marking engine 230 and the halftoning may be performed within the marking engine 230 which may include functionalities of the adaptive ink flushing controller 220 described above.

In further embodiments, the adaptive ink flushing controller 220 may implement further processing to ensure that the same pixel is not simultaneously flushed by more than one color of ink. For example, for color CMYK printing, multiple halftones may be used, one for each color and for multiple printheads 470. The adaptive ink flushing controller 220 may thus analyze multiple halftones to prevent flushing by more than one color at the same location on the print medium. Alternatively or additionally, the adaptive ink flushing controller 220 may analyze the print data to perform flushing operations on top of black print data such that the flush marks are hidden on the print data.

For embodiments that print flush lines 250, the adaptive ink flushing controller 220 may direct a full line flush in the margin of a first page of a run. Thereafter, the adaptive ink flushing controller 220 adjusts the amount of ink flushed by the nozzle in the margin of the next printed page (or next line flush) downstream based on how recently it was last fired. For instance, the adaptive ink flushing controller 220 may decrease an instructed amount of ink (e.g., in comparison to an instruction for a regular or full line flush) to be ejected by the nozzle (e.g., firing instruction) for the line flush based on the inactive firing span. As already described above, the inactive firing span may be a recent time-average ink flow through that nozzle determined by a counter that resets in response to a fired drop, and the reset may be a fixed average value, an average value computed based on drop size, an average value computed based on a prior value of the counter, etc.

In applying the techniques described herein to flushing in the form of flush lines 250 or flush patterns 252, up to 100% of flushing ink may be saved in printing colorful full page photos. Moreover, in printing dense text with flush patterns 252, up to 50% of flushing ink may be saved. Additionally, a general increase in print quality may be realized due to the elimination of excess marks in the printed image as a result of adaptively minimizing flushing according to print data and/or flushing on top of same-colored or black print data. For example, richer and deeper whites may be realized in and around colored regions to achieve higher contrast, particularly for white text over a dark background.

Figure 6:
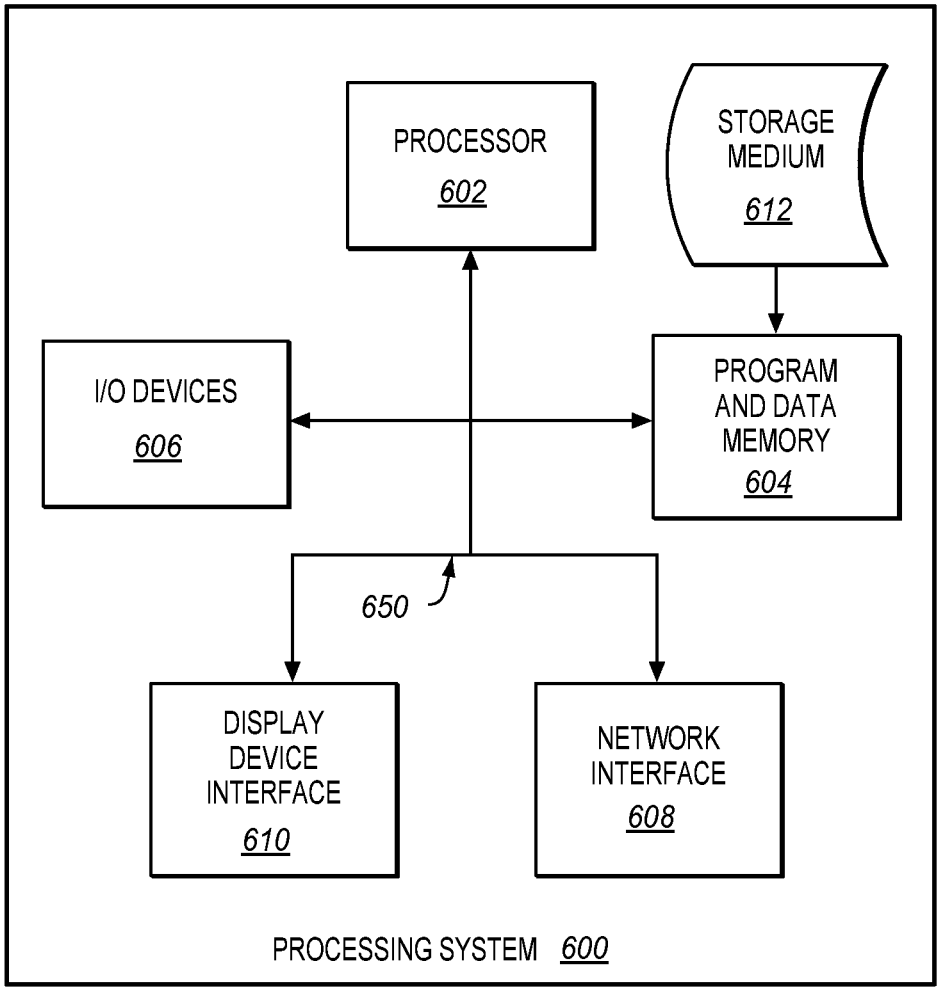
FIG. 6 illustrates a processing system operable to execute a computer readable medium embodying programmed instructions to perform desired functions in an illustrative embodiment.

Embodiments disclosed herein can take the form of software, hardware, firmware, or various combinations thereof. In one embodiment, functions described herein are implemented in software, which includes but is not limited to firmware, resident software, microcode, etc. FIG. 6 illustrates a processing system 600 operable to execute a computer readable medium embodying programmed instructions to perform desired functions in an illustrative embodiment. Processing system 600 is operable to perform the above operations by executing programmed instructions tangibly embodied on computer readable storage medium 612. In this regard, embodiments may take the form of a computer program accessible via computer-readable medium 612 providing program code for use by a computer or any other instruction execution system. For the purposes of this description, computer readable storage medium 612 can be anything that can contain or store the program for use by the computer such as an electronic, magnetic, optical, electromagnetic, infrared, or semiconductor device. Examples of computer readable storage medium 612 include a solid state memory, a magnetic tape, a removable computer diskette, a random access memory (RAM), a read-only memory (ROM), a rigid magnetic disk, and an optical disk. Current examples of optical disks include compact disk—read only memory (CD-ROM), compact disk—read/write (CD-R/W), and DVD.

Processing system 600, being suitable for storing and/or executing the program code, includes at least one processor 602 coupled to program and data memory 604 through a system bus 650. Program and data memory 604 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 606 (including but not limited to keyboards, displays, pointing devices, etc.) can be coupled either directly or through intervening I/O controllers. Network adapter interfaces 608 may also be integrated with the system to enable processing system 600 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 610 may be integrated with the system to interface to one or more display devices, such as printing systems and screens for presentation of data generated by processor 602.

Although specific embodiments were described herein, the scope is not limited to those specific embodiments. Rather, the scope is defined by the following claims and any equivalents thereof.

What is claimed is:

1. An apparatus comprising:

an adaptive ink flushing controller configured to obtain nozzle firing data for a nozzle of a printhead, to analyze the nozzle firing data to determine an inactive firing span of the nozzle, and, in response to determining that the inactive firing span of the nozzle exceeds a threshold, to transmit a firing instruction for ejecting ink, wherein the adaptive ink flushing controller is configured to determine the inactive firing span of the nozzle by counting between nozzle firings of the nozzle according to the nozzle firing data, and wherein the adaptive ink flushing controller is configured to initialize a count to a first counting value, to advance the count for each increment of time or each time related event for which the nozzle does not eject ink, to reset the count to a second counting value if the nozzle firing data instructs the nozzle to activate prior to the count exceeding a threshold, and, if the count exceeds the threshold, to transmit the firing instruction for ejecting ink.

2. The apparatus of claim 1 wherein:

the adaptive ink flushing controller is configured to determine the second counting value based on a randomly distributed value of an average reset value of the nozzle.

3. The apparatus of claim 1 wherein:

the adaptive ink flushing controller is configured to determine the second counting value based on a size of one or more drops specified by the nozzle firing data of the nozzle.

4. The apparatus of claim 1 wherein:

the adaptive ink flushing controller is configured to receive an instruction to output a line flush in a page margin for a print job, and to decrease an instructed amount of ink of the line flush to be ejected by the nozzle for the line flush based on the inactive firing span.

5. The apparatus of claim 1 wherein:

the threshold is based on an ink type.

6. The apparatus of claim 1 further comprising:

an inkjet printer configured to receive and process the nozzle firing data.

7. A method comprising:

obtaining nozzle firing data for a nozzle of a printhead;

analyzing the nozzle firing data to determine an inactive firing span of the nozzle;

in response to determining that the inactive firing span of the nozzle exceeds a threshold, transmitting a firing instruction for ejecting ink;

determining the inactive firing span of the nozzle by counting between nozzle firings of the nozzle according to the nozzle firing data;

initializing a count to a first counting value;

advancing the count for each increment of time or each time related event for which the nozzle does not eject ink;

resetting the count to a second counting value if the nozzle firing data instructs the nozzle to activate prior to the count exceeding a threshold; and if the count exceeds the threshold, transmitting the firing instruction for ejecting ink.

8. The method of claim 7 further comprising:

determining the second counting value based on a randomly distributed value of an average reset value of the nozzle.

9. The method of claim 7 further comprising:

determining the second counting value based on a size of one or more drops specified by the nozzle firing data of the nozzle.

10. The method of claim 7 further comprising:

receiving an instruction to output a line flush in a page margin for a print job;

tracking the inactive firing span of the nozzle during printing of the print job; and decreasing an instructed amount of ink of the line flush to be ejected by the nozzle for the line flush based on the inactive firing span.

11. A non-transitory computer readable medium embodying programmed instructions which, when executed by a processor, are operable for performing a method comprising:

obtaining nozzle firing data for a nozzle of a printhead;

analyzing the nozzle firing data to determine an inactive firing span of the nozzle;

in response to determining that the inactive firing span of the nozzle exceeds a threshold, transmitting a firing instruction for ejecting ink;

determining the inactive firing span of the nozzle by counting between nozzle firings of the nozzle according to the nozzle firing data;

initializing a count to a first counting value;

advancing the count for each increment of time or each time related event for which the nozzle does not eject ink;

resetting the count to a second counting value if the nozzle firing data instructs the nozzle to activate prior to the count exceeding a threshold; and if the count exceeds the threshold, transmitting the firing instruction for ejecting ink.

12. The medium of claim 11 wherein the method further comprises:

determining the second counting value based on a randomly distributed value of an average reset value of the nozzle.

13. The medium of claim 11 wherein the method further comprises:

determining the second counting value based on a size of one or more drops specified by the nozzle firing data of the nozzle.

14. The medium of claim 11 wherein the method further comprises:

receiving an instruction to output a line flush in a page margin for a print job;

tracking the inactive firing span of the nozzle during printing of the print job; and decreasing an instructed amount of ink of the line flush to be ejected by the nozzle for the line flush based on the inactive firing span.

* * * * *